United States Patent [19]

Albus et al.

[11] 4,214,375

[45] Jul. 29, 1980

[54] FLASH DRYER

[75] Inventors: Francis E. Albus, Hatboro; George W. Fendler, Doylestown, both of Pa.

[73] Assignee: Aljet Equipment Company, Willow Grove, Pa.

[21] Appl. No.: 911,889

[22] Filed: Jun. 2, 1978

Related U.S. Application Data

[63] Continuation-in-part of Ser. No. 805,833, Jun. 13, 1977, abandoned.

[51] Int. Cl.[2] ..... F26B 3/08

[52] U.S. Cl. ..... 34/10; 34/57 E; 432/58

[58] Field of Search ..... 34/10, 57 R, 57 E; 432/58, 251

[56] References Cited

U.S. PATENT DOCUMENTS

| | | | |
|---|---|---|---|
| 2,284,746 | 6/1942 | Kidwell | 34/57 E |
| 2,351,091 | 6/1941 | Bar | 34/57 E |
| 2,502,916 | 4/1950 | Bar | 34/57 E |
| 2,592,231 | 4/1952 | Allstott | 34/10 |
| 3,196,827 | 7/1965 | Wurster et al. | 34/10 |
| 3,922,796 | 12/1975 | Stephanoff | 34/57 E |
| 3,958,342 | 5/1976 | Stephanoff | 34/57 E |

*Primary Examiner*—John J. Camby
*Attorney, Agent, or Firm*—George A. Smith, Jr.

[57] ABSTRACT

In a closed-loop flash dryer, hot gas is introduced through a horizontal or downwardly directed nozzle. This configuration is especially adapted for drying heat-sensitive materials. The use of a single nozzle eliminates damage to equipment which results from differential expansion.

4 Claims, 9 Drawing Figures

FLASH DRYER

CROSS-REFERENCE TO RELATED APPLICATION

This application is a continuation-in-part of our copending application, Ser. No. 805,833, filed June 13, 1977, now abandoned.

SUMMARY OF THE INVENTION

This invention relates to flash dryers, and particularly to an improved flash dryer capable of treating a wide variety of substances, including heat-sensitive materials.

One well-known type of flash dryer currently in use for drying various particulate substances is the closed-loop flash dryer. A typical closed-loop flash dryer comprises a conduit arranged in a loop to provide a path for the travel of particles in the conduit under the influence of a stream of heated gas (usually air or steam) introduced into the conduit.

The material to be dried is introduced into the circulating gas stream, and is rapidly dried. The time required to dry most particles is of the order of milliseconds, and the dried particles are centrifugally separated from those which are still moist, by virture of the curvature of the loop. The dried particles are removed from the loop through an outlet passage. The stream of gas causes the remaining moist particles to be circulated through the conduit until dry. When the particles eventually lose their moisture content, their mass decreases, and they leave the conduit along with the gas through the outlet passage. The outlet passage is positioned on the conduit in such a way that the wet, massive particles, which are subject to a greater centrifugal force as they pass through the conduit, do not pass through the outlet passage, while the dry, less massive particles, being subject to a lesser centrifugal force, find their way through the outlet. In the loop dryer, therefore, the wet particles are circulated until they are adequately dried, and the product passing through the outlet is uniformly dry.

There are various loop dryers in existence which operate by recirculation of material and centrifugal separation, but do not effect "flash" drying, i.e. substantially instantaneous removal of moisture from the material to be treated. A typical loop dryer of this type is described in U.S. Pat. No. 2,351,091, issued June 13, 1944 to Peter Joachim Bar. The operation of Bar's apparatus is characterized by the fact that the solid particles to be treated remain in circulation considerably longer than the gas. In contrast, in the operation of a loop-type flash dryer, the rate of circulation of gas is higher than the rate of circulation of solid material. That is, the quantity of solid material passing a point in the dryer immediately following the material inlet per unit time divided by the quantity of solid material introduced and withdrawn from the dryer per unit time is less than the quantity of gas passing a point immediately following the gas inlet per unit time divided by the quantity of gas introduced and withdrawn per unit time. In a typical loop-type flash dryer, the rate at which gas is circulated is around ten times the rate at which gas is introduced and withdrawn. On the other hand, the rate at which solid material is circulated in the loop is nearly equal to the rate at which it is introduced and withdrawn.

The loop-type flash dryers presently in use are provided with multiple gas inlet nozzles arranged to direct gas upwardly from a manifold into the bottom portion of the conduit in a direction tangent to the centerline of the conduit. Particles to be treated are typically introduced into the conduit in the vertical or horizontal portion which precedes the nozzles in the direction of circulating flow. This arrangement is successful for the drying of many materials. However, when the dryer is shut down, some of the material being treated falls through the multiple gas inlet nozzles into the manifold. Heat-sensitive materials, polyvinyl chloride being a notable example, tend to decompose when they come into contact with the extremely hot walls of the manifold. Consequently, when the dryer is restarted, decomposed material either remains in and clogs the manifold, or is introduced into the product as a contaminant. These heat-sensitive materials also tend to adhere to the extremely hot portions of the internal wall of the dryer conduit, which become hot by reason of conduction of heat from the adjacent gas inlet nozzles. Consequently, deposits of material tend to build up within the conduit, interfering with the proper operation of the dryer.

The first important object of this invention is to provide a loop-type flash dryer in which heat-sensitive materials are not decomposed during shut down of the dryer. This object is accomplished in accordance with the invention by the use of nozzles which are directed horizontally or downwardly. These nozzles, being directed horizontally or downwardly, prevent the heat-sensitive material from falling into the manifold when operation is temporarily shut down.

The second important object of the invention is to provide a loop-type flash dryer which is capable of treating heat-sensitive materials without having them accumulate at the location of the gas inlet nozzles. This objective is accomplished very simply and effectively by a preferred form of the invention in which an arrangement of gas inlet nozzles is provided wherein all of the nozzles are arranged to direct gas substantially in directions tangent to the centerline of the conduit and in which said directions are limited to downward directions.

The presence of multiple nozzles in conventional loop-type flash dryers also gives rise to problems resulting from the expansion of metal. In some dryers, a box manifold is used. The box manifold has a large opening which receives all of the nozzles (typically three or four), and the boundary of the opening is welded to the loop. In these dryers, it has been found that differential expansion at extremely high temperatures can cause failure at the welded joint between the manifold and the loop. In other dryers the several nozzles are connected to a hot gas manifold which is separate from the loop. In many cases it has been found necessary to provide expansion joints in the connections between the manifold and the loop in order to prevent cracks from forming in the various welds in the dryer. But, even expansion joints do not provide an adequate solution to the problem, because they do not eliminate damage caused by expansion of the manifold relative to the loop. A third important object of the invention is to eliminate these problems which result from expansion, and in accordance with the invention, hot gas is introduced into the conduit through a single tangential nozzle. In a preferred form of the invention the air heater is permitted to float with respect to the loop, and this configuration eliminates the need for an expansion joint at the high temperature end of the heater.

Many of the features of the invention which will be described in detail with reference to a loop dryer are applicable to J dryers as well, that is dryers in which the particles to be treated are directed, under the influence of a hot gas, downwardly, and then upwardly into a tall stack, the dryer having the configuration of the letter "J".

Various other objects will be apparent from the following description when read in conjunction with the drawings.

Any of the four feed devices in FIGS. 1, 2, 5 and 6 can be used in any of the four embodiments illustrated in those figures.

DETAILED DESCRIPTION

For the purpose of the description and claims the following definitions are applicable:

"Centerline" refers to the locus of centers of the planar cross-sections of a conduit, the cross-sections being generally perpendicular to the direction of flow in the conduit where they are taken, and each center corresponding to the center of gravity of a uniformly dense planar sheet coincident with the cross-sectional plane and defined by an outline corresponding to the intersection of the cross-sectional plane with the inner wall of the conduit.

"Tangent" means substantially in the same direction at the location of closest approach.

"Downward" means any direction the vertical component of which is directed toward the center of the earth.

"Upward" means any direction the vertical component of which is directed away from the center of the earth.

"Loop-Type Flash Dryer" as used herein means a dryer in which solid particles are brought into contact with a heated gas which is recirculated in a loop, and in which the guanity of solid material per unit time passing a point in the loop immediately following the material inlet divided by the quantity of solid material introduced and withdrawn per unit time is less than the quantity of gas passing a point immediately following the gas inlet per unit time divided by the quantity of gas introduced and withdrawn per unit time.

Figure 1:
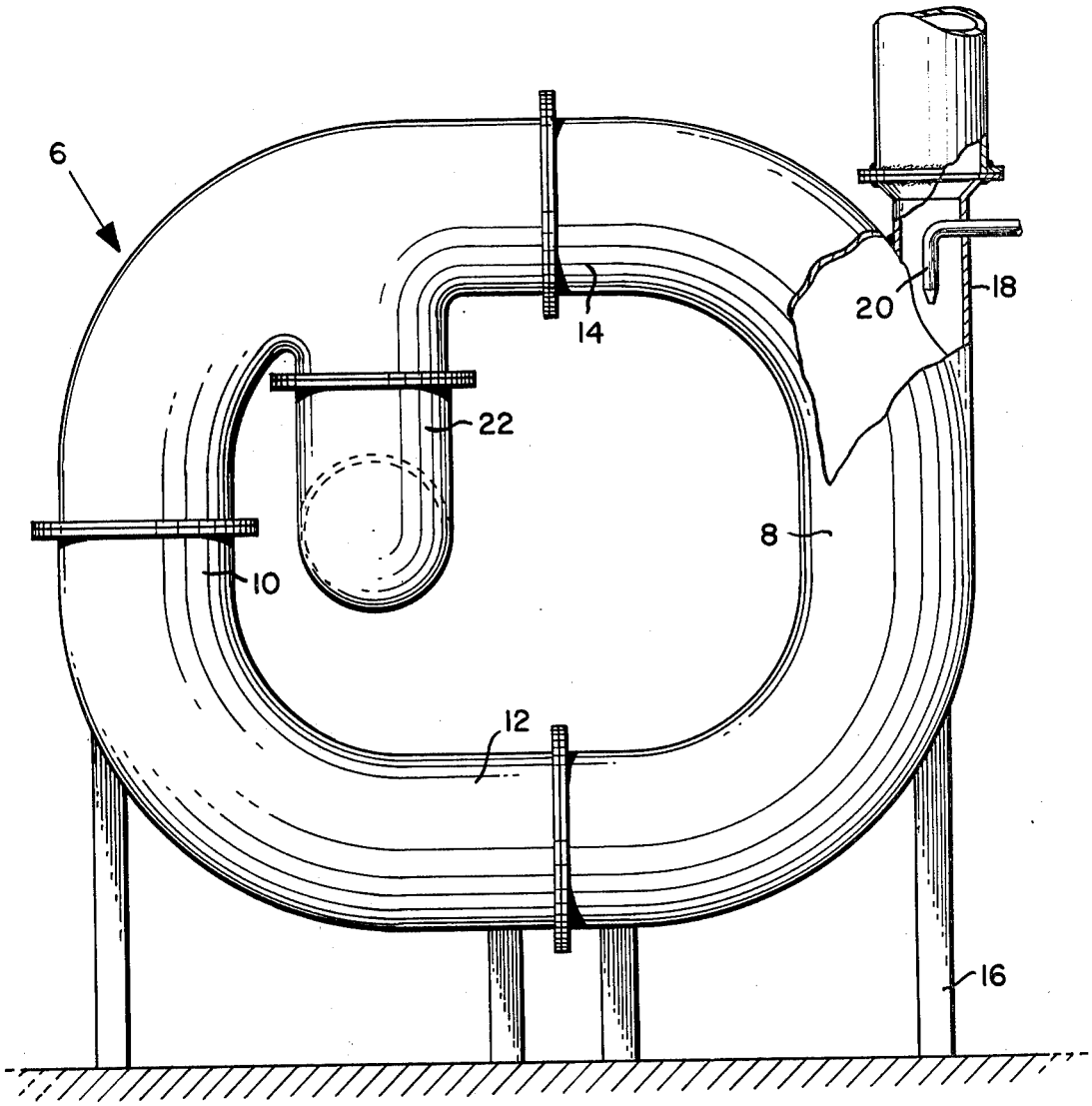
FIG. 1 is a partially cut-away elevation of a preferred flash dryer in accordance with the invention, the dryer having a single, downwardly directed nozzle and an atomizer feed.

FIG. 1 shows a flash dryer 6 of the loop type. The dryer comprises a conduit forming a closed loop. The loop can take various shapes such as circular, elongated rectangular, a "D" shape, or a square shape as shown. Although in some cases sections of the conduit may not be sharply defined from one another, the closed loop conduit can be thought of as having a first section 8 providing for downwardly directed flow, a second section 10 providing for upwardly directed flow, a third section 12 interconnecting sections 8 and 10 at the bottoms thereof, and a fourth section 14 interconnecting sections 8 and 10 at the tops thereof. The conduit is preferably supported by a base 16 so that, when the conduit is in its normal operating position, its centerline is situated in a substantially vertical plane.

The conduit is provided with a gas inlet nozzle 18, arranged to conduct a stream of hot gas into the conduit substantially in a direction tangent to the centerline of the conduit. The nozzle can be located at any one of numerous locations on the conduit so long as the gas is directed either horizontally or downwardly, and in a direction substantially tangent to the centerline. Preferably, however, the nozzle is directed downwardly, as such an arrangement more completely eliminates upwardly-facing extremely hot conduit walls which would tend to cause accumulation of heat-sensitive materials. In the preferred embodiment shown in FIG. 1 the nozzle is arranged to direct a gas passing through it in a substantially vertical downward direction. This nozzle is preferably located near the top of conduit section 8.

Various material feeding devices can be used successfully with the dryer of FIG. 1. For example, screw conveyors, rotary valves, atomizers, pneumatic feeders, and other devices can be used to introduce particles of material to be dried into the conduit. In FIG. 1, for example, there is shown an atomizer nozzle 20, located within gas nozzle 18. The atomizer nozzle sprays a slurry of particles into the stream of hot gas passing through nozzle 18.

In the operation of the dryer of FIG. 1, the material to be dried is fed directly into the gas stream passing through nozzle 18 by reason of the location of nozzle 20 immediately adjacent the location of nozzle 18. This insures that much of the moisture in the material is removed immediately as the particles are introduced.

At the upper left-hand corner of the conduit is an outlet 22 which connects to the interior of conduit 6 through an opening in the conduit wall directed toward the inside of the loop. The outlet provides for the centrifugal separation of dry from wet particles and conducts dried particles and gas from conduit 6 to a suitable collector (not shown).

In the dryer of FIG. 1 as there are no upwardly facing hot surfaces surrounding nozzles as in the conventional dryers, the accumulation of heat-sensitive materials is greatly reduced or eliminated. As the gas nozzle is directed downwardly, heat-sensitive material being treated cannot fall into the nozzle when the dryer is in the process of starting up or shutting down.

Figure 2:
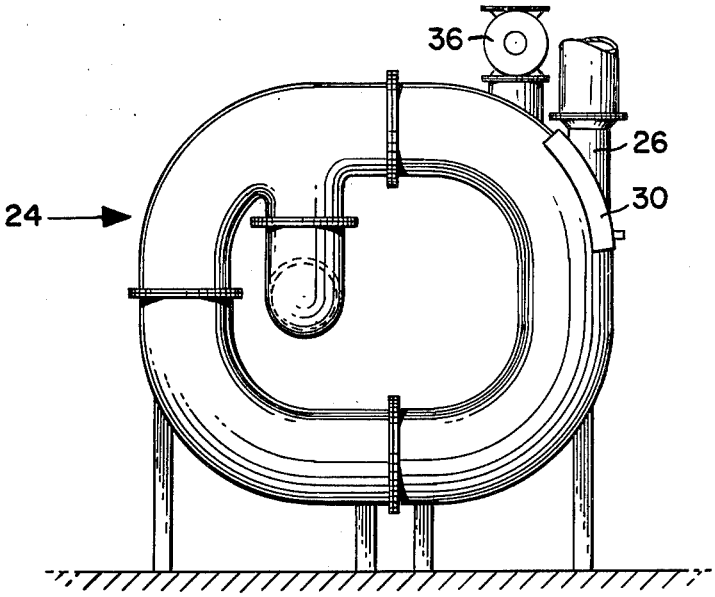
FIG. 2 is an elevation of a modified flash dryer in accordance with the invention having a single downwardly directed nozzle, a water jacket surrounding the nozzle and feed means of the rotary valve type.
Figure 3:
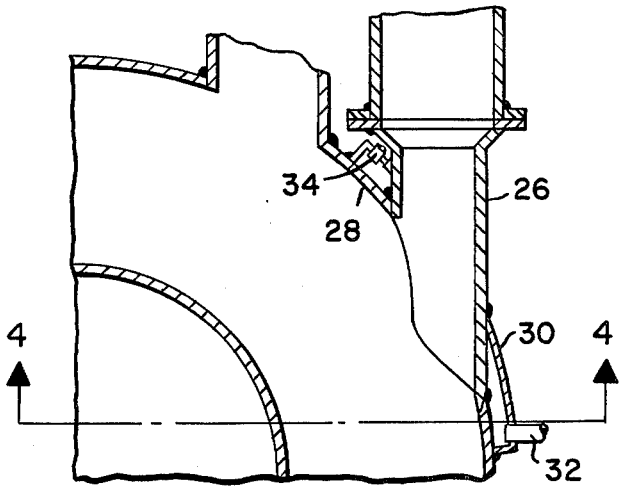
FIG. 3 is a vertical section showing the details of the nozzle and water jacket of the apparatus of FIG. 2.
Figure 4:
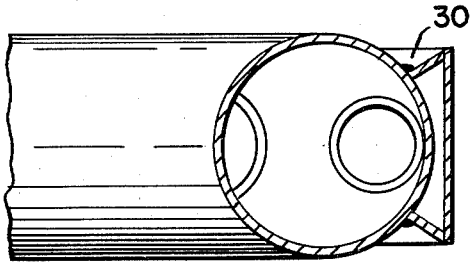
FIG. 4 is a horizontal section taken on the plane 4—4 of FIG. 3.

FIGS. 2, 3 and 4 show a loop-type flash dryer 24, similar to the dryer of FIG. 1 in most respects, except that the nozzle is provided with a coolant jacket, and a different particle feeding device is used.

The dryer is provided with a gas inlet nozzle 26. This nozzle is similar to the one shown in FIG. 1 in its location and the direction of its gas jet.

Some heat-sensitive materials tend to accumulate to some extent even on downwardly-facing surfaces such as surface 28 (FIG. 3) on the inner wall of the conduit. This is due to heat conducted to the conduit surface from the gas inlet nozzle. In order to eliminate the possibility of accumulation of material on surface 28, a coolant jacket 30 is provided. The coolant jacket surrounds nozzle 26, and nozzle 26 extends through the jacket to the interior of the conduit. A coolant, typically water, is pumped into the jacket through pipe 32, and removed from the jacket through pipe 34. The coolant carries away heat which would otherwise be conducted to surface 28 from the nozzle through the wall of the conduit. The coolant prevents surface 28 from reaching the temperatures at which a chemical or physical change in heat-sensitive materials might cause their accumulation on the conduit walls.

As best shown in FIGS. 3 and 4, the jacket 30 is welded to the conduit and to the nozzle to provide a water-tight closure, and is so configured with respect to the nozzle that the coolant completely surrounds the nozzle where the nozzle enters the conduit.

Particles of the material to be dried are introduced into the conduit through a rotary valve 36. The rotary valve is located immediately adjacent the nozzle. This insures that the particles introduced into the conduit are immediately subjected to the hot stream of gas entering the conduit from the nozzle, and thereby insures efficient operation of the dryer.

Figure 5:
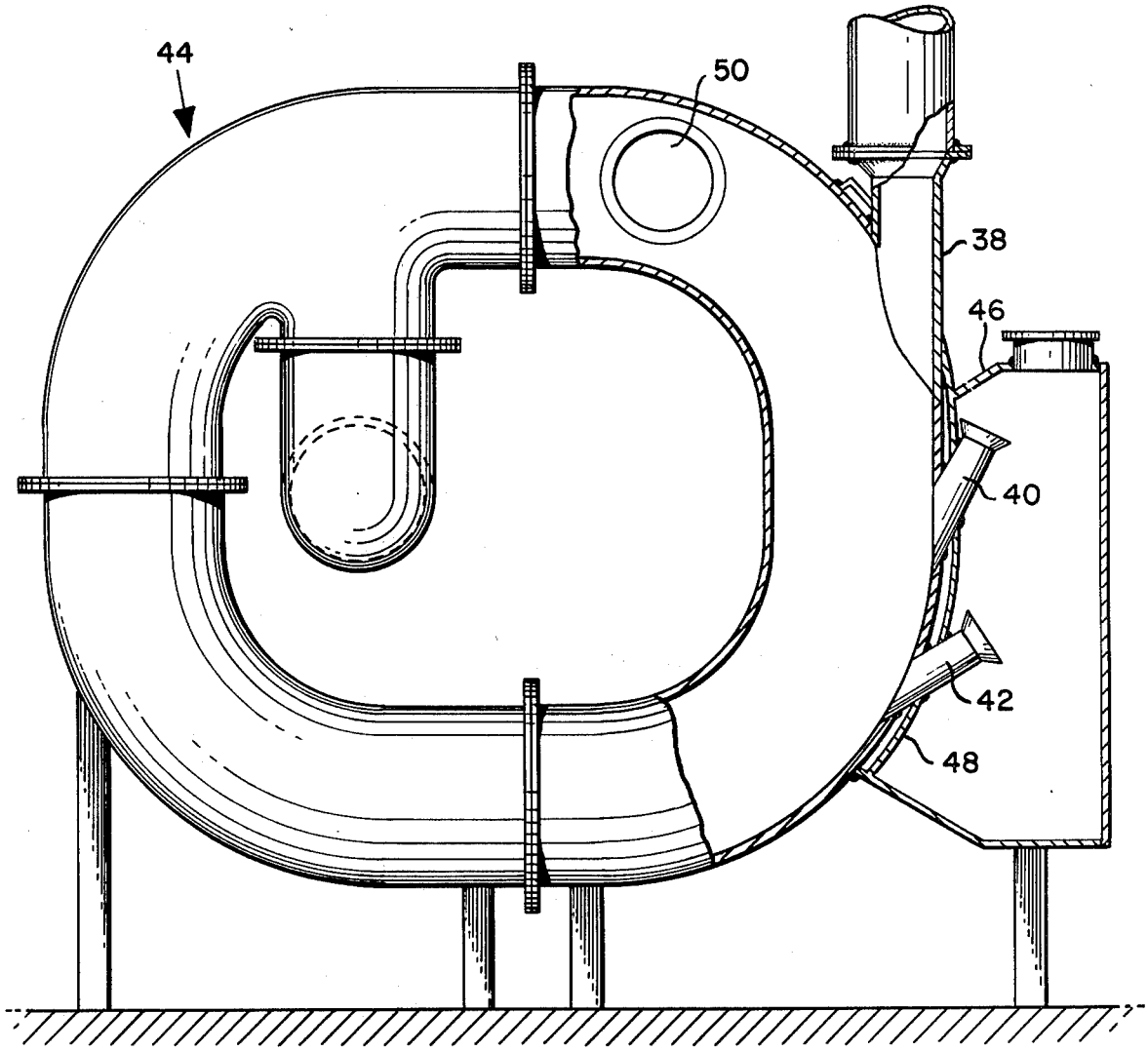
FIG. 5 is an elevation, partly in section, of a flash dryer in accordance with the invention, having a main downwardly directed nozzle, and auxiliary nozzles, all having a common water jacket. The figure also illustrates a screw-type feed device for the introduction of materials into the conduit.

FIG. 5 shows a further alternative embodiment of the invention in which a vertical, downwardly directed nozzle 38 is supplemented by a pair of additional downwardly-directed nozzles 40 and 42. The main stream of hot gas is directed into the conduit 44 through nozzle 38, which can be of a larger diameter than auxiliary nozzles 40 and 42. The auxiliary nozzles are supplied with hot gas from a manifold 46, which receives gas from the same source which supplies nozzle 38.

Each of the three nozzles is arranged to direct gas substantially in directions tangent to the centerline of the conduit. The gas jet from nozzle 38 is directed in a vertical downward direction. The gas jet from nozzle 40 is downward, but oblique, and the gas jet from nozzle 42 is also downward and oblique, though nearly horizontal.

As there are no upwardly directed nozzles, the problem of heat-sensitive materials falling through nozzles during start-up or shut down of the dryer is eliminated. Furthermore, the problem of accumulation of heat-sensitive materials on the walls of the conduit is substantially eliminated for most materials. However, as some materials tend to accumulate even on sloping walls of a conduit, a coolant jacket can be provided. Coolant jacket 48 serves all three nozzles, and is configured in such a way that coolant completely surrounds each of the nozzles. Coolant is pumped through the jacket from its lower portion to its upper portion by pumping means (not shown). The portion of the jacket adjacent nozzle 38 operates in the same manner as the coolant jacket shown in FIG. 3. The portion of the coolant jacket enclosed by manifold 46, prevents heat from the manifold from reaching the inner wall of the conduit.

A screw conveyor 50 delivers material to be dried into the conduit immediately adjacent the location of primary nozzle 38 to insure the immediate removal of moisture from the particles and the efficient operation of the dryer.

Figure 6:
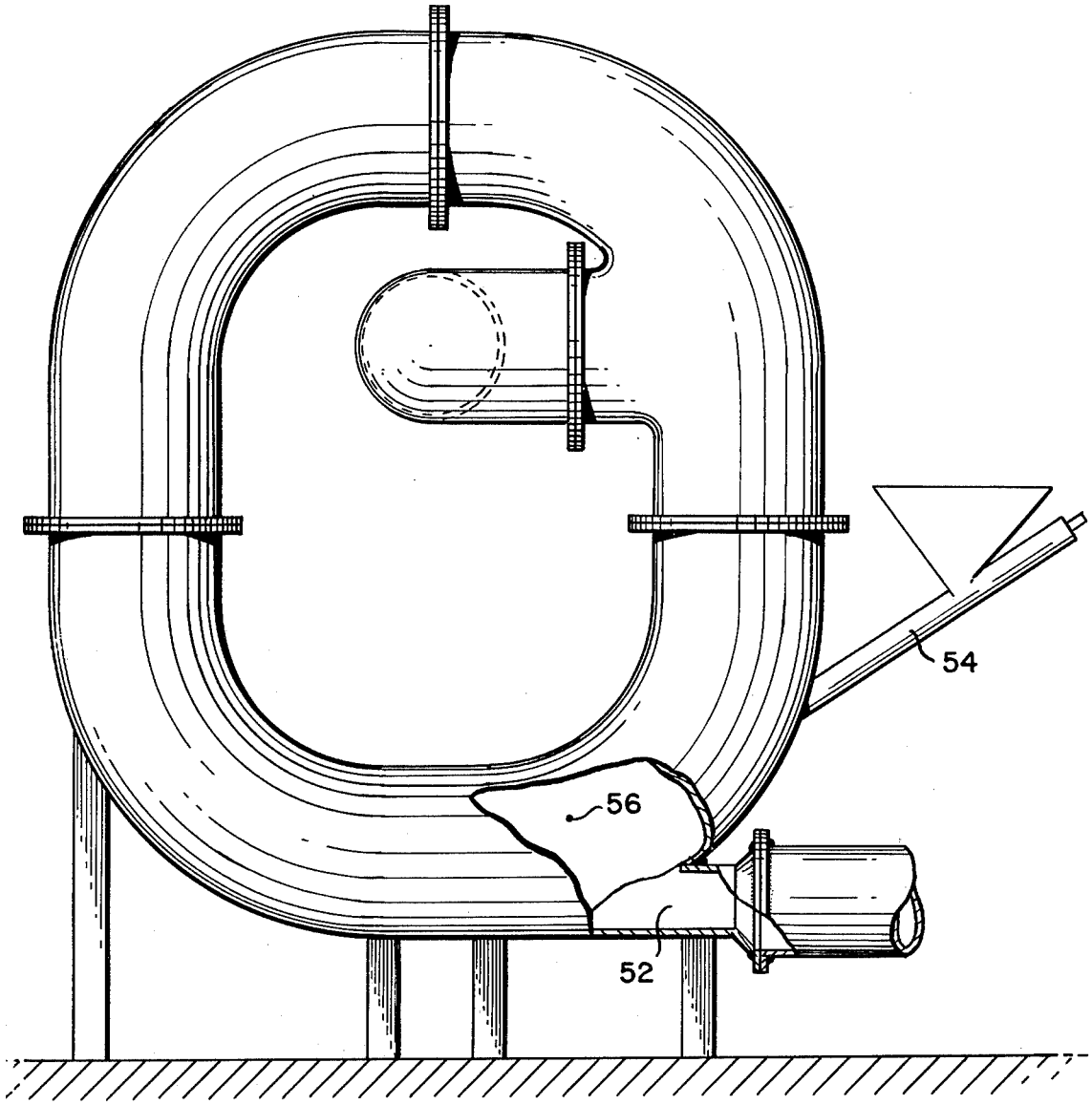
FIG. 6 is a partially cut-away elevation of a flash dryer having a single, horizontally directed nozzle and a pneumatic feed.

The dryers of FIGS. 1–5 are preferred because the downwardly directed nozzles not only prevent the entry of particles of heat-sensitive material into a manifold, but also because the use of downwardly directed nozzles either eliminate or at least keeps to a minimum the upwardly facing, extremely hot areas surrounding the nozzles, on which heat-sensitive material tends to accumulate in conventional dryers. An alternative is the dryer of FIG. 6 in which the gas inlet nozzle 52 is horizontally located near the bottom of the loop, and directed in a direction substantially tangent to the centerline of the loop following a pneumatic feeder 54. In the dryer of FIG. 6, material does not tend to move outwardly from the conduit through nozzle 52. This eliminates the major problem in treating heat-sensitive materials. There is, however, some upwardly-facing surface at 56 surrounding the nozzle, on which heat-sensitive material may tend to accumulate.

So far, only the structure satisfying the first two objects of the invention has been discussed, namely the use of horizontal, or downwardly directed nozzles for the purpose of preventing heat-sensitive materials from falling into a manifold, and the use of downwardly directed nozzles for the purpose of preventing the accumulation of heat-sensitive materials on the internal walls of the dryer conduit. FIGS. 1, 2, 3, 4 and 6, however, illustrate another important aspect of the invention by which various problems resulting from differential expansion are eliminated by introducing hot gas into the dryer through a single nozzle rather than through multiple nozzles as in the conventional apparatus. A dryer having a single hot gas nozzle can be effectively used for treating heat-sensitive materials, where the nozzle is downwardly directed, as shown in FIG. 1, or where the nozzle is horizontal, as illustrated in FIG. 6.

It will be seen that in the case of the dryers in FIGS. 1 and 6 for example, the use of a single nozzle eliminates problems resulting from differential expansion which often occur where a manifold is used. There is no box manifold, and hence no possibility of damage to the weldment where the large opening in the box manifold is joined to the loop. Nor is there a separate manifold with the problems inherent in multiple connection between the manifold and the loop.

Figure 7:
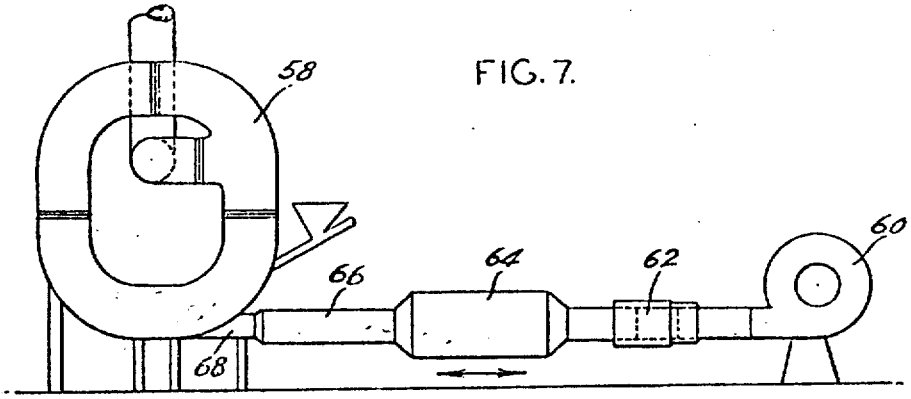
FIGS. 7, 8 and 9 are schematic views of three alternative flash drying systems, showing the blower and air heater.
Figure 8:
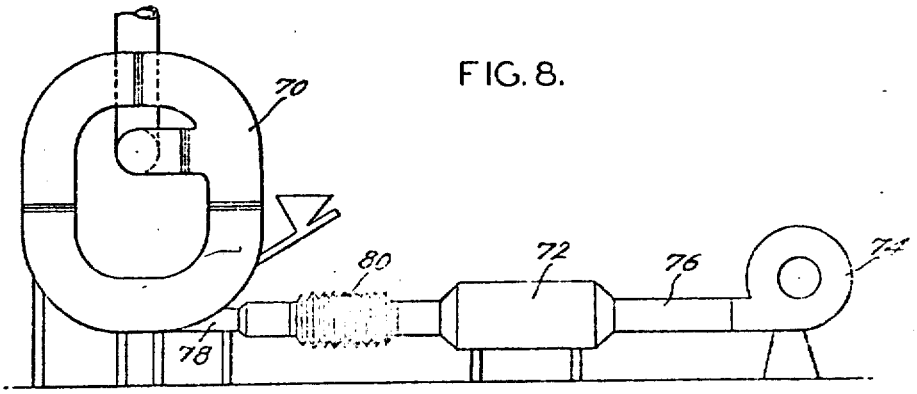
Figure 9:
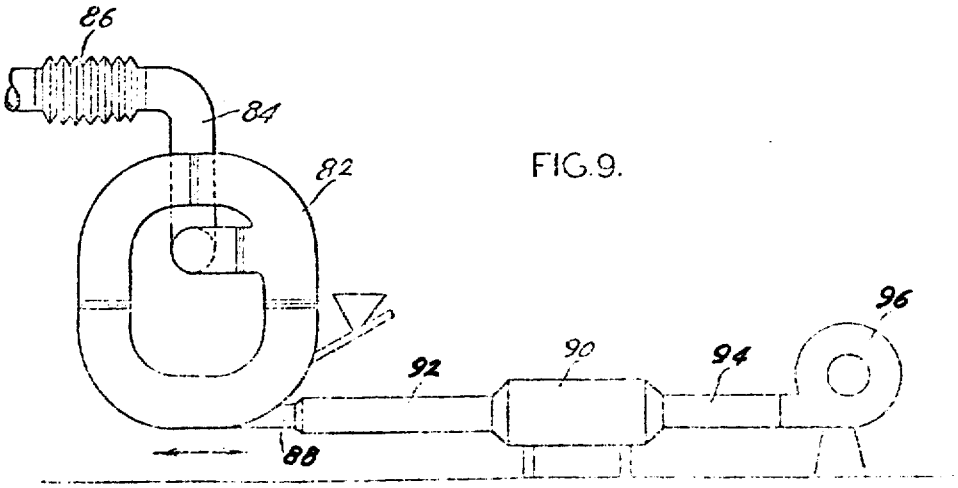

In the dryer according to the invention, expansion can be accommodated simply by allowing the dryer and air heater to float relative to each other or by providing a simple expansion joint between the dryer and air heater. FIGS. 7, 8 and 9 illustrate these various methods of accommodating thermal expansion. In FIG. 7, dryer 58 is anchored to the floor, as is blower 60. An expansion joint 62 is provided between blower 60 and air heater 64, and the heater is allowed to float in the horizontal directions indicated by the double-ended arrow. Thermal expansion in the heater itself, and in the connection 66 between the heater and nozzle 68 is accommodated simply by horizontal floating movement of the heater, which can be mounted on a suitable sliding support (not shown), if desired.

In FIG. 8, dryer 70 is anchored to the floor, as are heater 72 and blower 74. As there is no serious expansion problem on the upstream side of the heater, the blower can be connected to the heater through a rigid conduit 76.

The heater is connected to nozzle 78 of the dryer through a metal bellows 80, which accommodates thermal expansion while allowing the dryer, the heater and the blower all to be anchored. Alternative forms of expansion joints other than the metal bellows can be used.

In FIG. 9, a dryer 82 is arranged to float horizontally, and its outlet conduit 84 is provided with an expansible bellows 86, this bellows being desirable in order to prevent horizontal movement of the dryer from damaging the outlet conduit or affecting associated equipment. Air inlet nozzle 88 of dryer 82 is connected rigidly to heater 90 through conduit 92. Heater 90 is anchored to the floor and is connected through a rigid conduit 94 to blower 96, which is also anchored to the floor.

The use of a single nozzle to eliminate problems of the cracking of the weldments is applicable to dryers intended for materials other than heat-sensitive materials. Accordingly, the single nozzle need not be downwardly directed or horizontal, but can be upwardly directed, if desired for any reason.

We claim:

1. A flash dryer comprising:

a dryer conduit arranged to provide a path for the travel of particles in said conduit under the influence of a stream of heated gas introduced into said conduit;

said conduit having a first section providing for downwardly directed flow, a second section providing for upwardly directed flow, and a third section interconnecting said first and second sections at the bottoms thereof;

said flash dryer having only one gas inlet nozzle, said nozzle being arranged to direct gas substantially in a direction tangent to the centerline of the conduit, and including a blower, and an air heater connected between said blower and said gas inlet nozzle and arranged to heat the air delivered by said blower and to deliver said air to said nozzle, said heater being rigidly connected to said nozzle through rigid conduit means, and means for accommodating thermal expansion of said rigid conduit means comprising means for supporting said heater while allowing floating movement of said heater with respect to said dryer conduit in the direction of, and at least to the extent of, the thermal expansion of said rigid conduit means.

2. A method of drying particulate matter comprising: introducing wet solid particulate matter into a conduit, introducing a single stream of heated gas into said conduit and into contact with said particulate matter therein, withdrawing dried solid particulate matter from said conduit, and withdrawing gas from said conduit wherein the rates of introduction and withdrawal of gas are the same and the rates of introduction and withdrawal of solid matter are the same, and controlling the rates of introduction and withdrawal of gas and solid matter so that the quantity per unit time of solid material passing a point in the conduit immediately following the material inlet, divided by the quantity of solid material introduced and withdrawn from the conduit per unit time is less than the quantity per unit time of gas passing a point in said conduit immediately following the gas inlet divided by the quantity of gas introduced and withdrawn per unit time.

3. A method of drying particulate matter comprising: introducing wet, solid particulate matter into a conduit, introducing a heated gas into said conduit and into contact with said particulate matter therein through gas nozzle means, in directions which are limited to horizontal and downward directions, withdrawing dried solid particulate matter from said conduit, and withdrawing gas from said conduit wherein the rates of introduction and withdrawal of gas are the same and the rates of introduction and withdrawal of solid matter are the same, and controlling the rates of introduction and withdrawal of gas and solid matter so that the quantity per unit time of solid material passing a point in the conduit immediately following the material inlet, divided by the quantity of solid material introduced and withdrawn from the conduit per unit time is less than the quantity per unit time of gas passing a point in said conduit immediately following the gas inlet divided by the quantity of gas introduced and withdrawn per unit time.

4. A flash dryer comprising:

a dryer conduit arranged to provide a path for the travel of particles in said conduit under the influence of a stream of heated gas introduced into said conduit;

said conduit having a first section providing for downwardly directed flow, a second section providing for upwardly directed flow, and a third section interconnecting said first and second sections at the bottoms thereof;

said flash dryer having only one gas inlet nozzle, said nozzle being arranged to direct gas substantially in a direction tangent to the centerline of the conduit, and including a blower, and an air heater connected between said blower and said gas inlet nozzle and arranged to heat the air delivered by said blower and to deliver said air to said nozzle, said heater being rigidly connected to said nozzle through rigid conduit means and means for accommodating thermal expansion of said rigid conduit means comprising means for supporting said dryer conduit while allowing floating movement of said dryer conduit with respect to said air heater in the direction of, and at least to the extent of, the thermal expansion of said rigid conduit means.

* * * * *

UNITED STATES PATENT AND TRADEMARK OFFICE

CERTIFICATE OF CORRECTION

PATENT NO. : 4,214,375

DATED : July 29, 1980

INVENTOR(S) : Francis E. Albus et al

It is certified that error appears in the above—identified patent and that said Letters Patent is hereby corrected as shown below:

Figures 7, 8 and 9 has been inserted as part of Letters Patent No. 4,214,375 as shown on the attached sheet.

Signed and Sealed this

*Sixteenth* Day of *February 1982*

[SEAL]

*Attest:*

GERALD J. MOSSINGHOFF

*Attesting Officer*

*Commissioner of Patents and Trademarks*